United States Patent [19]

Gorrell et al.

[11] 3,948,413

[45] Apr. 6, 1976

[54] PAINT BRUSH HOLDING ATTACHMENT FOR PAINT CANS

[76] Inventors: John E. Gorrell, 400 E. Pedregosa St., Santa Barbara, Calif. 91303; Fred Lichtgarn, 314 Evonshire St., Santa Barbara, Calif. 93111

[22] Filed: July 5, 1974

[21] Appl. No.: 485,783

[52] U.S. Cl. ..... 220/90; 15/257.05; 248/110

[51] Int. Cl.[2] ..... B44D 3/12; B65D 25/00

[58] Field of Search ..... 15/257.05, 260, 263; 220/90; 211/65; 248/110–113; 401/121

[56] References Cited

UNITED STATES PATENTS

| | | | |
|---|---|---|---|
| 1,734,976 | 11/1929 | McClellan | 15/257.05 UX |
| 2,566,877 | 9/1951 | Dunton | 220/90 |
| 2,567,326 | 9/1951 | Entsminger | 220/90 |
| 2,676,730 | 4/1954 | Hedglon | 248/110 X |
| 2,803,374 | 8/1957 | Cash | 220/90 |
| 2,807,431 | 9/1957 | McHale | 248/113 |
| 3,275,187 | 9/1966 | Lamoureaux | 220/90 |

*Primary Examiner*—Daniel Blum
*Attorney, Agent, or Firm*—Jack C. Munro; James E. Hawes

[57] ABSTRACT

An attachment for a paint can for supporting a paint brush when not in use and for wiping excess paint from the paint brush. The attachment is formed of a main sheet material member which is folded upon itself to form a first leg and a second leg with both legs extending substantially in the same general direction. The first leg extends within the access opening of the paint can and has attached thereto an upturned member which protrudes back through the access opening and terminates exteriorly of the paint can. The second leg is in contact with the exterior surface of the paint can. Securing means are provided between the first leg and the second leg to securely position the attachment upon the paint can.

9 Claims, 10 Drawing Figures

PAINT BRUSH HOLDING ATTACHMENT FOR PAINT CANS

BACKGROUND OF THE INVENTION

The field of this invention relates to devices for holding paint brushes on paint cans or buckets where the brush is filled with paint and it is desired to hold the brush so that the paint will drip back into the bucket, and in particular, a paint brush holder that may be stamped from a single piece of sheet material and which may include a clamp for securing the device on the side of the can.

The round shaped inner rim of a conventional round paint can was never designed to be used as the means for wiping a paint brush of its excess paint. By using this rim a person wipes too much paint from the outer edges of the paint brush and leaves too much paint in the center of the brush (due to the roundness of the can rim). Also, when the brush is wiped on the paint can rim that paint drips into the can lip and upon the lip of the can becoming filled, or if the can is tilted, the paint within this lip will flow over the exterior edge of the lip and down the exterior surface of the can. Besides wasting paint, the outer surface of the can becomes quite messy and once the paint reaches the bottom of the can, wherever the can is placed, some of the paint will remain.

Previously, there have been attempts to construct an attachment to paint cans which would overcome the above-noted difficulties. However, most such attachments have required machine work in the forming and assembling of the parts and this substantially increases the cost so that such attachments are very seldom used.

Previously, there have also been attempts at designing an inexpensive attachment which is formed of a single piece of sheet material. However, such attachments have not satisfactorily overcome the above-noted difficulties and such attachments have also been bulky in size thereby not facilitating portability.

SUMMARY OF THE INVENTION

The attachment of this invention is to connect to the can adjacent the access opening into an open can of paint. The attachment formed from a main sheet material and has a first leg integrally connected to a second leg, the first leg being located directly adjacent the second leg. The first leg may extend through the access opening and into the paint can, the second leg then being in contact with the rim of the paint can and positioned adjacent the exterior of the can. First means are provided to connect the first leg to the interior rim of the paint can, and securing means are provided to force the second leg into a tight connection with the exterior rim of the can. Preferably, the first means includes at least one notch in the side of first leg, the notch being shaped to fit about the bead defining the interior rim and preventing vertical movement in both directions. The first leg terminates in an upturned member which extends through the access opening and terminates externally of the can to form a supportive surface for the bristle end or tip of the paint brush when it is placed against the first leg. The attachmen. of this invention is to position the paint brush more or less vertically (slightly inclined) so that the brush handle is not subject to having the paint flow upon it from the bristle end. The upright position also makes it easy for the user to pick up the brush and replace it with or without dipping it in the paint. The attachment of this invention is formed of a spring metal part to connect with the paint can by an inherent biasing action and remain connected with the paint can by such biasing action In another embodiment, a fastening means is employed to provide for a more secure connection to the paint can if desired. The attachment of this invention fastens itself to the top of the paint can by gripping both the inner and outer rim of the paint can.

Other important features of the inventon are set forth in the following detailed description, and in the claims.

This invention serves a dual purpose in that it incorporates both a secure place where a wet paint brush can be placed and held when necessary, and also, provides a flat edge where the paint brush can be wiped to remove excess paint, this edge also functioning to evenly distribute the paint along the entire brush. The attachment of this invention can be quickly and easily attached and removed from a paint can. The attachment of this invention is designed to be mass produced at minimum cost. The main objective of this invention is to improve the painting operation and to substantially eliminate the harm and annoyance caused by paint dripping off of a full paint brush and down the outer sides of the paint can and to the bottom of the can. The attachment of this invention substantially eliminates any paint dripping off the paint brush exteriorly to the can. The attachment of this invention generally improves painting results because the paint will be distributed more evenly when the paint brush is wiped upon the attachment of this invention. The attachment of this invention includes the further objective as being able to include a handle (or bail) in order to be employed as a lifting means for the entire paint can. The paint brush when supported in the attachment of this invention is free to drain the excess paint directly into the open paint can without any of the paint coming into contact with the handle end of the brush or the outside of the paint can. By using the attachment of this invention there is no reason to have the paint enter the lid groove around the can so that lid can be replaced without having the groove filled or contaminated with paint.

DETAILED DESCRIPTION OF THE SHOWN EMBODIMENTS

Figure 1:
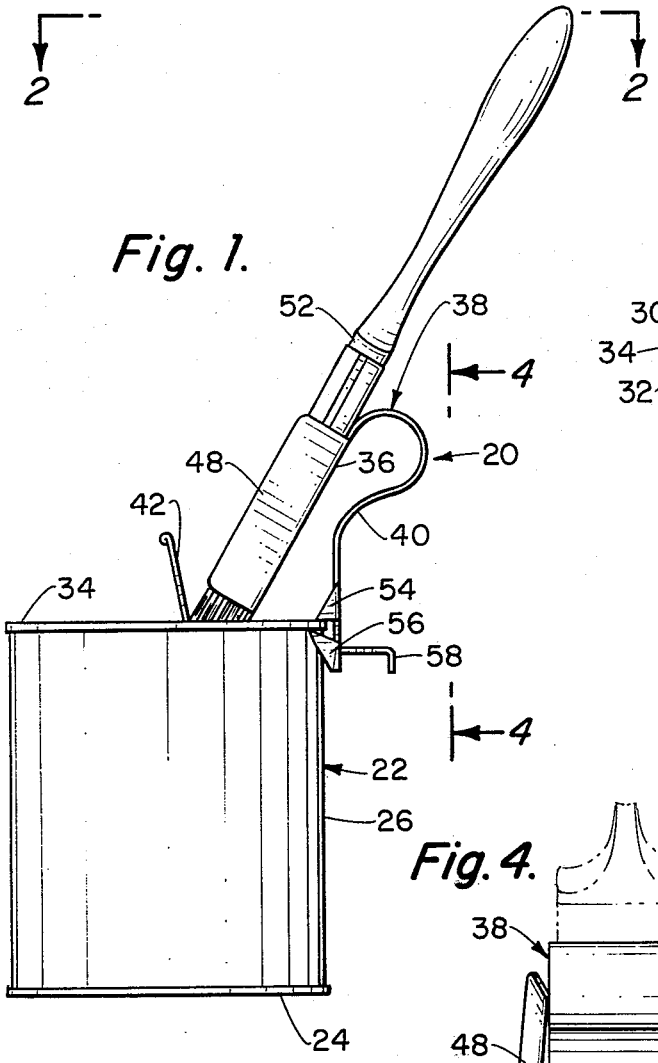
FIG. 1 is a side view of a paint can incorporating the first embodiment of attachment of this invention.
Figure 3:
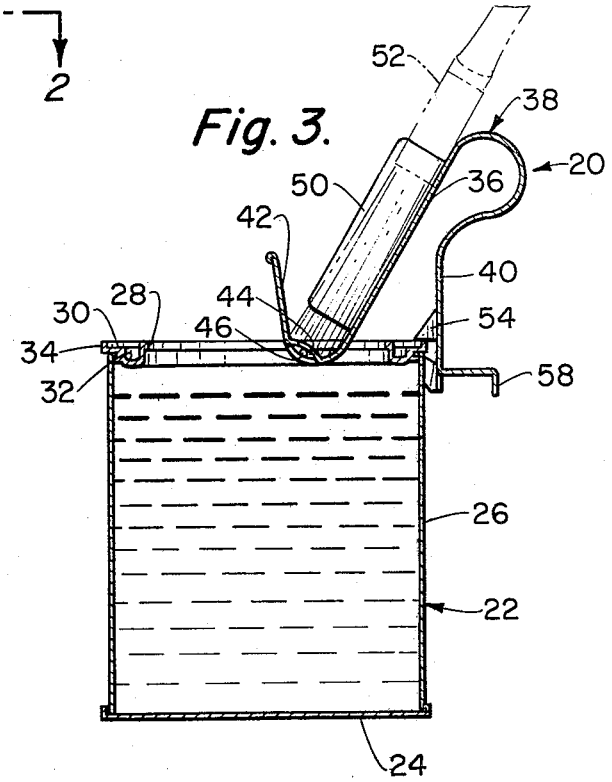
FIG. 3 is a cross sectional view of a paint can and the first embodiment of attachment of this invention taken along line 3—3 of FIG. 2.

Referring particularly to the drawings, there is shown in FIG. 1 the first embodiment 20 of attachment of this invention which is mounted upon a conventional paint can 22. The paint can 22 includes a bottom 24 and a cylindrical side wall 26. Referring particularly to FIG. 3, through the top of the can is provided an access opening 28. Surrounding the access opening is an annular lip 30. The lip 30 includes an annular recess groove 32 which facilitates secure connection to a paint can lid (not shown). The annular lip 30 includes an enlarged bead 34 about its circumference. This bead 34 slightly extends out from the side wall 26.

The first embodiment 20 of attachment of this invention is formed entirely of rigid sheet material and will normally be constructed of metal. However, it is considered to be within the scope of this invention to employ other types of material such as plastic.

The first embodiment 20 includes a main member 38 which is to form generally into a first leg 36 and a second leg 40. Basically, the general shape of the main member 38 is U-shaped, wherein the second leg 40 is located adjacent the first leg 36 and extends substantially in the same direction.

The free end of the first leg 36 is connected to an upturned member 42. The first leg 36 is of such a length that it will extend through the access opening 28 and slightly into the interior of the paint can 22. The upturned portion 42 extends exteriorly of the access opening and terminates slightly above the access opening 28. Also, the upturned member 42 extends across the paint can 22, but not through the center of the can 22.

Figure 4:
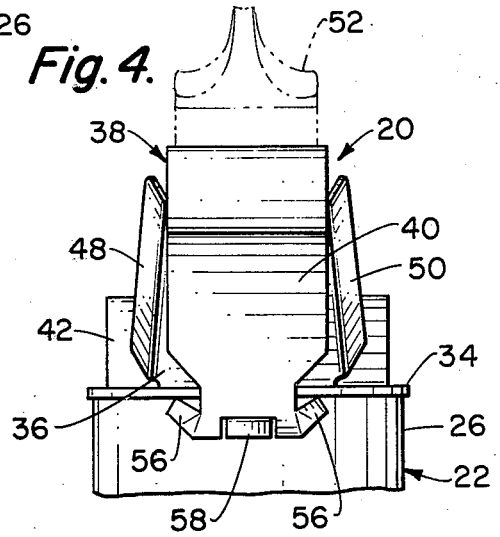
FIG. 4 is an end view of the attachment of this invention taken along line 4—4 of FIG. 1.
Figure 2:
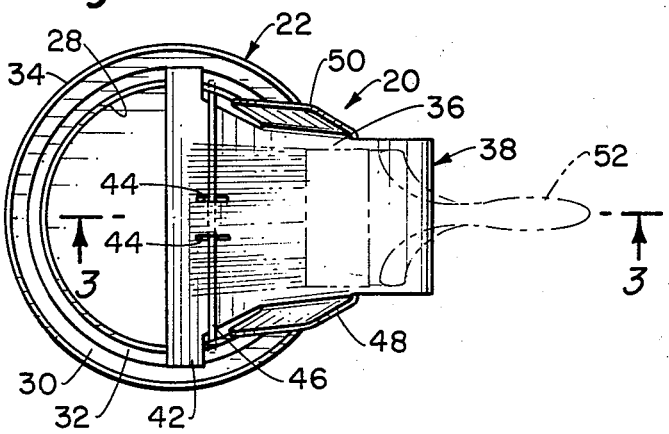
FIG. 2 is a plan view of the first embodiment of attachment of this invention taken along line 2—2 of FIG. 1.
Figure 5:
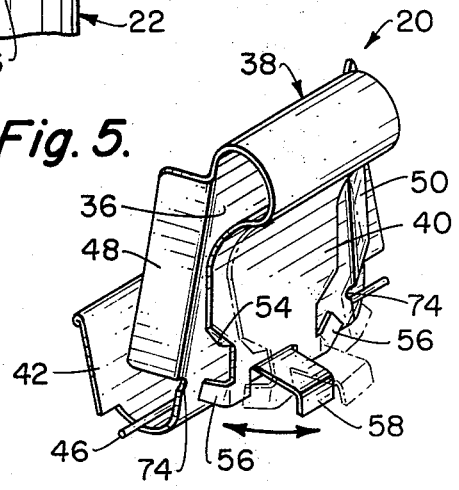
FIG. 5 is isometric view of the first embodiment of attachment of this invention.
Figure 6:
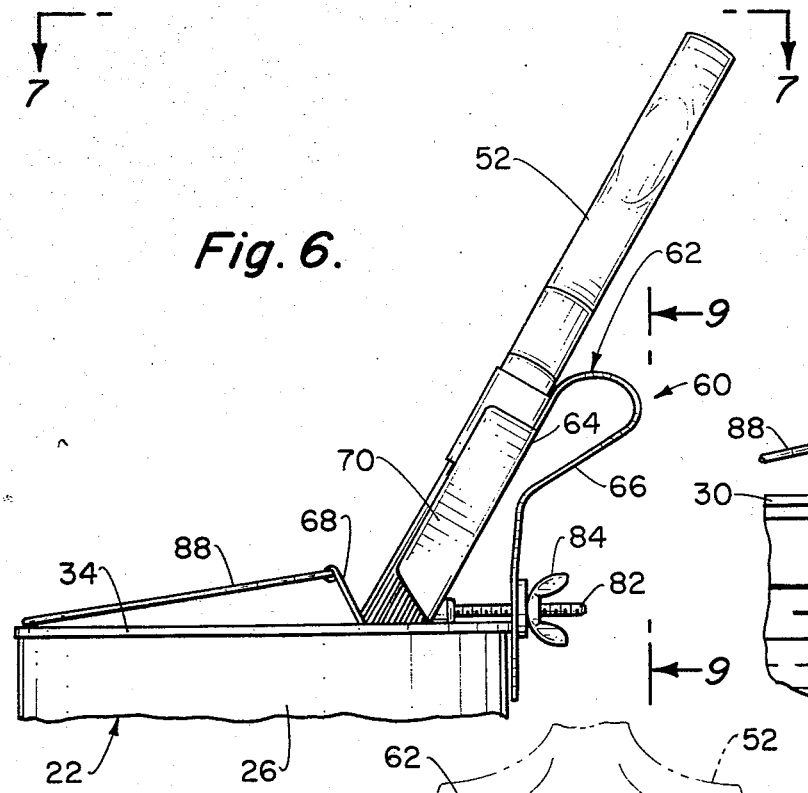
FIG. 6 is a side view of the second embodiment of attachment of this invention.
Figure 8:
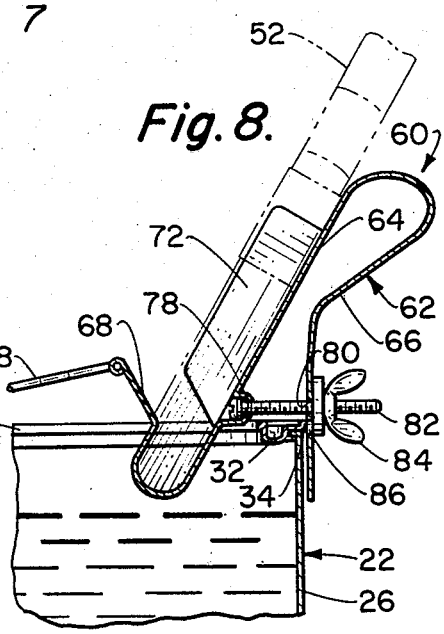
FIG. 8 is a cross sectional view of the second embodiment of attachment of this invention taken along line 8—8 of FIG. 7.
Figure 9:
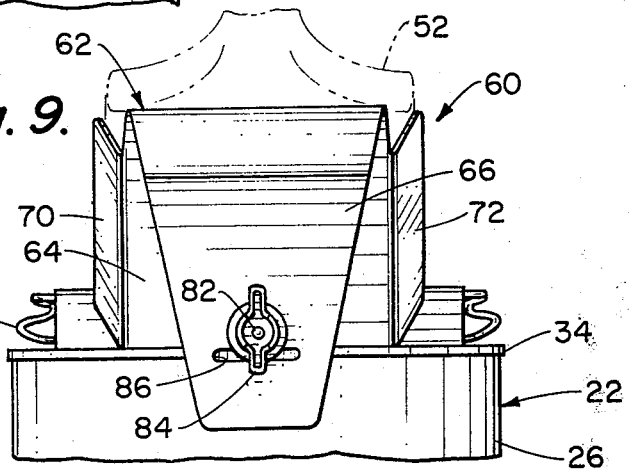
FIG. 9 is an end view of the second embodiment of attachment of this invention taken along line 9—9 of FIG. 6.
Figure 7:
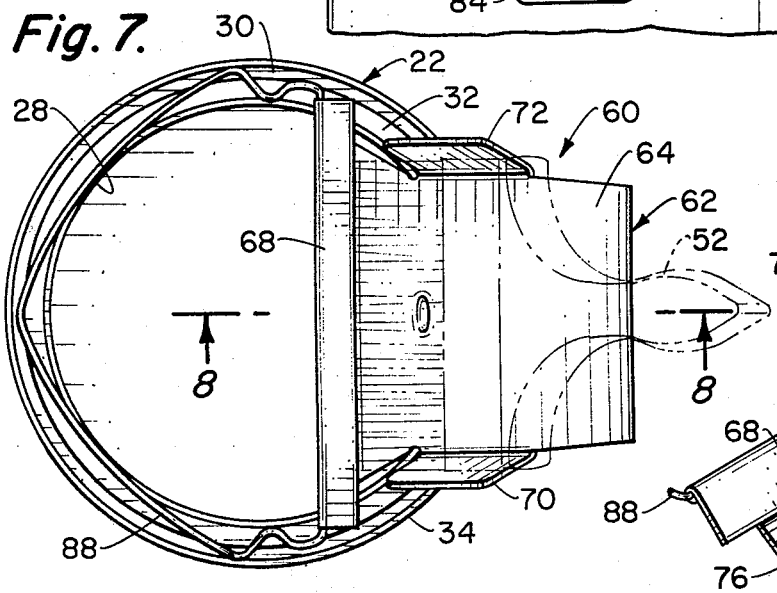
FIG. 7 is a plan view of the second embodiment of attachment of this invention taken along line 7—7 of FIG. 6.
Figure 10:
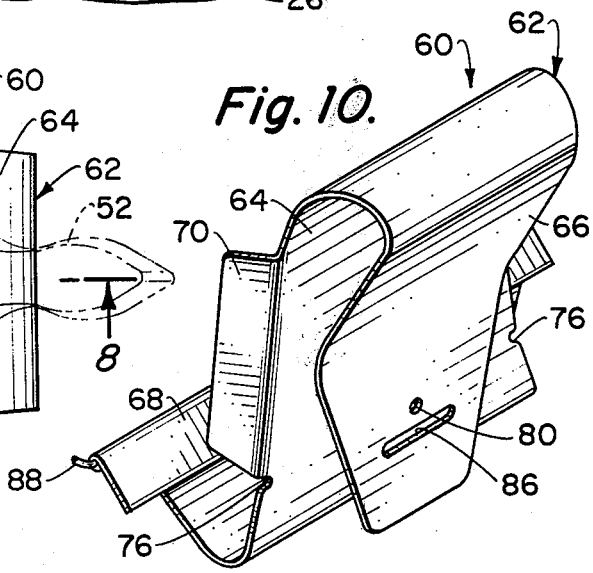
FIG. 10 is an isometric view of the second embodiment of attachment of this invention.

At the junction of the first leg 36 to the upturned member 42 is formed a pair of cut-outs 44. Conducted through the cut-outs 44 is a longitudinal rod 46. The cut-outs 44, in cooperation with the main member 38, function to retain the rod 46 in its useable position. The length of the rod 46 is preselected so that with the attachment installed upon the paint can as shown in FIGS. 2 to 4, each end of the rod 46 is in contact with the under surface of the lip 30. Therefore the rod 46 functions to restrain the attachment 20 and prevent withdrawing movement of such with respect to the paint can 22.

The lateral edges of the first leg 36 include side walls 48 and 50. The side walls 48 and 50 function to laterally restrain the paint brush 52 when placed in contact with the main member 38 as shown in the drawings.

Formed within each lateral edge of the first edge 36 are notches 74. The notches 74 are to connect with the inner edge of lip 30 which thereby facilitates the securing of the attachment 20 to the paint can 22.

The second leg 40, adjacent its free end, includes a pair of upper securing tabs 54 and a pair of lower securing tabs 56. The tabs 54 are adapted to come into contact with the upper surface of the annular bead 34 with the tabs 56 coming into contact with the lower surface of the annular bead 34. Also located adjacent the free end of the second leg 40 is an enlarged tab 58 which is to function as a handle to assist in removing the attachment for removing of the device.

The construction of the first embodiment 20 of this invention is such that there is an inherent resiliency or biasing action tending to force the first leg 36 toward the second leg 40 when installed upon a paint can. This biasing action is sufficient to prevent normal accidental dislodgment from the paint can, but it is not sufficient in this instance to permit the entire paint can to be lifted by means of the attachment 20. Under normal usage the first embodiment 20 of this invention should remain secured to the paint can without fear of having it being accidentally removed. This securing means, in essence, comprises the location of the rod 46 beneath the lip 30 and also the cooperating arrangement between the tabs 54 and 56 with respect to the bead 34.

In order to install the first embodiment 20 of attachment of this invention, it is necessary to first place the bar 46 under the annular lip and then to place the tabs 54 and 56 in position. In order to remove the attachment 20 of this invention it is only necessary to reverse the procedure by grasping the handle 58, dislodging tabs 54 and 56 from the bead 34 and then removing the bar 46.

The attachment 20 of this invention can be readily employed to support a paint brush 52 wherein the bristles of the paint brush rest against the junction of the first leg 36 to the upturned member 42, the junction defining a trough area, and also against the rod 46. The rod 46 serves the additional function of providing a surface for the paint to flow upon and then be conducted back into the paint can.

Referring in particular to FIGS. 6 to 10 of the drawings there is shown the second embodiment 60 of attachment of this invention. The second embodiment 60 is mounted upon a paint can in a manner similar to the first embodiment and like numerals have been employed to refer to like parts. The second embodiment 60 includes a main member 62 which is formed into a first leg 64 and a second leg 66. The shape of the first leg 64 with respect to the second leg 66 is essentially identical to the first embodiment 20. At the end of the first leg 64 is connected an upturned member 68 in precisely the same way as the first embodiment. Attached to the first leg 64 are side walls 70 and 72 which, in essence, are located on the first leg 64 in the same manner as was described with respect to the first embodiment.

The first leg 64 includes, in a manner similar to the first embodiment, notches 76 which are to connect with the inner edge of the lip 30 in the manner similar to what was previously described.

Within the second embodiment 60 it is to be noted that there is no bar 46 employed nor is there tabs 54 and 56 as well as a handle 58. Formed within the first leg 64 is an aperture 78 and within the second leg 66 is an aperture 80. The apertures 78 and 80 are aligned and are adapted to receive a threaded fastener 82. The head of the threaded fastener is located within a recess formed within the first leg 64 so as to prevent the bristles of the brush 52 from becoming entangled within the head of the fastener. A wing nut assembly 84 is to be threadably connected upon the fastener 82.

Formed within the second leg 66 is a slot 86. The slot 86 is adapted to receive a portion of the bead 34. Therefore, the cooperation of the bead 34 within the slot 86 and the cooperation of the inner edge of the lip 30 with the notches 76 restrains the attachment 60 against vertical movement once installed upon the paint can 22.

Because of the addition of the fastener 82 and by tightening of the wing nut 84, the attachment 60 is very securely fastened to the paint can 22. In fact, the attachment is so secure that a handle 88 or bail is attached to the free end of the upturned member 68. This handle 88 may be employed to pick up the entire paint can 22 even when it is filled with paint.

The installation of the second embodiment 60 of this invention is believed to be readily apparent and is installed by the tightening of the wing nut 84 upon the fastener 82. In order to effect removal of the second embodiment 60 it is only necessary to loosen the wing nut 84 upon the fastener 82.

Each of the embodiments 20 and 60 are formed from a single piece of sheet material so that all the elements are integral. The first embodiment 20 is entirely formed of sheet material and in the second embodiment 60 the entire device is integrally formed with the exception of the fastener with the inclusion of the fastener 82, the wing nut 84 and the handle 88. While preferred embodiments of the invention have been described and illustrated, variations will be obvious to those skilled in this art. Accordingly, the invention is defined by the following claims.

What is claimed is:

1. In combination with a paint can, said paint can having an access opening, an overhanging annular lip attached to said can and extending into said access opening, an enlarged annular bead formed upon the circumference of said lip, an attachment to connect with said can for supporting and wiping excess paint from the paint brush, said attachment comprising:

a main sheet material member having a first leg integrally connected to a second leg, said first leg being located directly adjacent said second leg, said first leg extending through said access opening and into said can;

first means connecting said first leg to said lip;

said second leg being in contact with said bead and positioned directly adjacent the exterior of said can, securing means connected to said second leg forcing said second leg into tight connection with the exterior of said can;

said first leg terminating in an upturned member which extends through said access opening and terminates exteriorly of said can, whereby the forming of said upturned member of a supportive surface is provided for the tip of the paint brush when it is placed against said main member and also the end of said upturned member providing a flat straight edge for wiping the brush; and said first means including a notch in each lateral edge of the first leg of the main sheet material member; the notch being located to receive the inner edge of said lip when said attachment is properly located upon said can, said first means further including a longitudinal rod, said rod resting on said first leg adjacent said upturned portion with each end of said rod being located in contact with the under surface of said lip.

2. The combination as defined in claim 1 wherein:

said securing means comprises a tab member attached to each lateral edge of said second leg, whereby said tab members are to be in contact with both the under surface of said enlarged annular bead and also the exterior surface of said can.

3. The combination as defined in claim 2 wherein:

the location of said second leg being such with respect to said first leg that upon installation within said can said legs are inherently biased together, whereby the bias force fixes said attachment in position upon said can.

4. The combination as defined in claim 3 wherein:

a handle is attached to said second leg projecting outwardly thereof, whereby the handle may be employed to spread the first and second legs, counteracting said bias force, to remove the attachment from said can.

5. In combination with a paint can, said paint can having an access opening, an overhanging annular lip attached to said can and extending into said access opening, an enlarged annular bead formed upon the circumference of said lip, an attachment to connect with said can for supporting and wiping excess paint from the paint brush, said attachment comprising:

a main sheet material member having a first leg integrally connected to a second leg, said first leg being located directly adjacent said second leg, said first leg extending through said access opening and into said can;

first means connecting said first leg to said lip;

said second leg being in contact with said bead and positioned directly adjacent the exterior of said can, securing means connected to said second leg forcing said second leg into tight connection with the exterior of said can;

said securing means including a threaded fastener interconnecting said first leg and said second leg, nut means connected with said fastener, upon tightening of said nut upon said threaded fastener said first leg is tightly forced in contact with said lip with said second leg tightly forced in contact with said enlarged annular bead;

said first leg terminating in an upturned member which extends through said access opening and terminates exteriorly of said can, whereby by the forming of said upturned member a supportive surface is provided for the tip of the paint brush when it is placed against said main member and also the end of said upturned member providing a flat straight edge for wiping the brush; and said first means including a notch in each lateral edge of the first leg of the main sheet material member, the notch being located to receive the inner edge of said lip when said attachment is properly located upon said can.

6. The combination as defined in claim 5 wherein:

said second leg including a horizontal slot, said slot to receive a portion of said enlarged annular bead.

7. The combination as defined in claim 6 wherein:

a handle attached to said upturned member whereby said handle may be employed to lift said can and its contents.

8. The combination as defined in claim 1 wherein:

the upturned member is connected to said first leg to provide a trough area for receiving the bristle end of the paint brush, the main member being formed to position the trough area above the paint level when the attachment is properly located upon said can.

9. The combination as defined in claim 1 wherein:

the relationship of the first and second legs, and the means connected thereto, being sufficient to locate the first leg in a slightly inclined outwardly extending position when the attachment is properly located upon said can and said can is resting upon a horizontal surface.

* * * * *